United States Patent [19]

Boyer

[11] Patent Number: 4,923,121

[45] Date of Patent: May 8, 1990

[54] SPRAY NOZZLE AND METHODS

[75] Inventor: Harold F. Boyer, Rosharon, Tex.

[73] Assignee: International Cellulose, Inc., Houston, Tex.

[21] Appl. No.: 259,968

[22] Filed: Oct. 18, 1988

[51] Int. Cl.[5] ..... B05B 7/04

[52] U.S. Cl. ..... 239/434.5; 239/427.3; 239/9

[58] Field of Search ..... 239/434.5, 427, 427.3, 239/8, 9, 10, 428

[56] References Cited

U.S. PATENT DOCUMENTS

| | | | |
|---|---|---|---|
| 2,433,463 | 12/1947 | Lampe . | |
| 2,578,412 | 12/1951 | Fisher . | |
| 2,683,625 | 7/1954 | Fisher . | |
| 2,732,258 | 1/1956 | Fisher . | |
| 3,214,103 | 10/1965 | Kempthorne . | |
| 3,255,973 | 6/1966 | Crowley . | |
| 3,476,318 | 11/1969 | Eckert | 239/434.5 |
| 4,185,001 | 1/1980 | Machurat et al. | 260/746 |
| 4,185,135 | 1/1980 | Huff | 428/96 |
| 4,185,778 | 1/1980 | Drlik | 239/434.5 |
| 4,187,983 | 2/1980 | Boyer | 239/9 |
| 4,213,936 | 7/1980 | Lodrick | 239/434.5 |
| 4,225,086 | 9/1980 | Sandell | 239/434.5 |
| 4,294,874 | 10/1981 | Howe | 427/393 |
| 4,360,440 | 11/1982 | Boyer et al. | 427/421 |
| 4,487,365 | 12/1984 | Sperber | 239/8 |
| 4,648,920 | 3/1987 | Sperber | 239/8 |
| 4,768,710 | 9/1988 | Sperber | 239/8 |
| 4,773,960 | 9/1988 | Vincelli et al. | 239/9 |

FOREIGN PATENT DOCUMENTS

| | | | |
|---|---|---|---|
| 1441 | of 1868 | United Kingdom | 239/434.5 |

*Primary Examiner*—Andres Kashnikow
*Assistant Examiner*—Christopher G. Trainor
*Attorney, Agent, or Firm*—Guy McClung

[57] ABSTRACT

A spray nozzle for spraying a mixture of fibrous insulating material and an adhesive for the fibrous insulating material. The nozzle has a hollow cylindrical body, a material conditioning chamber with a larger cross sectional area than the hollow cylindrical body, a generally conical spray hood adjacent the material conditioning chamber, a mixing chamber in the spray hood, and an adhesive feed line connected to and extending into the spray hood. The adhesive is homogeneously mixed with the fibrous insulating material in the spray hood.

5 Claims, 3 Drawing Sheets

FIG. 1
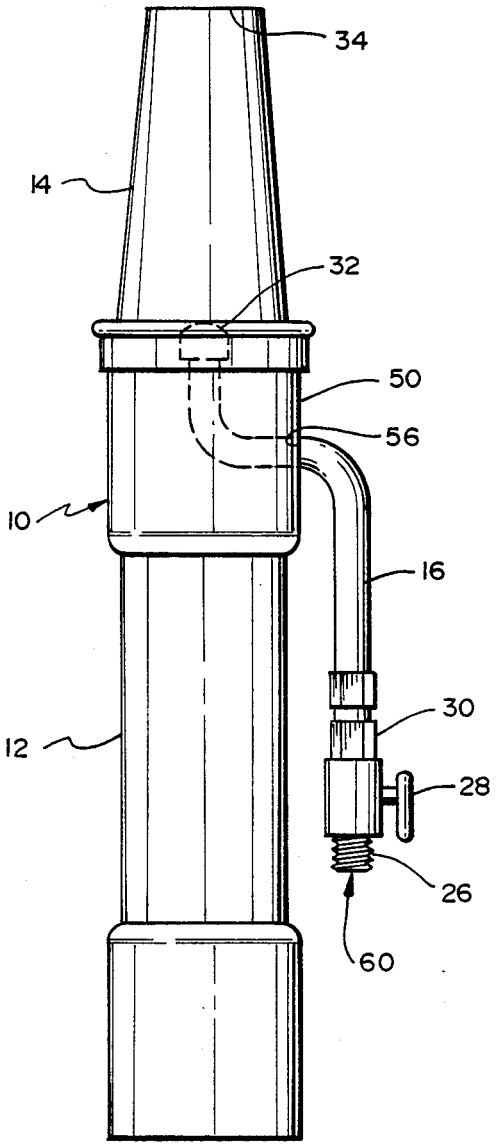
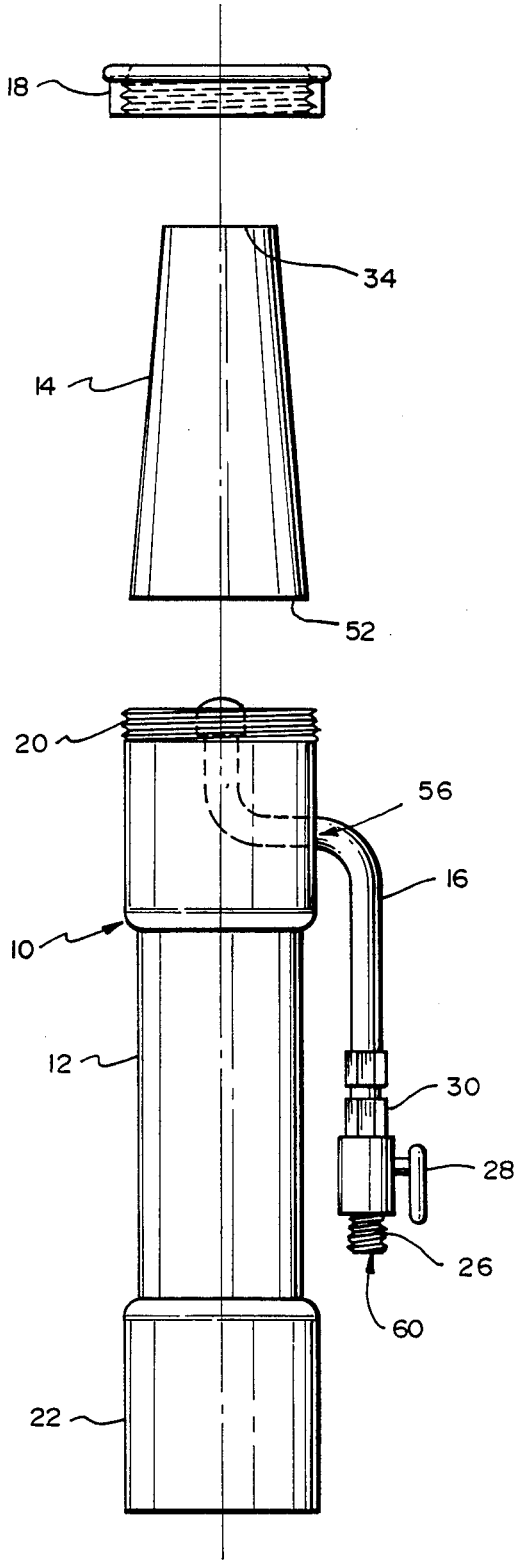
FIG. 2

SPRAY NOZZLE AND METHODS

BACKGROUND OF THE INVENTION

1. Field of the Invention

The present invention is related to spray nozzles for spraying two or more materials; to spray nozzles for spraying a material and a wetting agent for the material; to spray nozzles for spraying insulation material and an adhesive; and to methods for using all such nozzles.

2. Description of the Prior Art

My prior U.S. Pat. No. 4,187,983 describes my prior art plural component multi-state mixing and encapsulating nozzle as well as other prior art spray guns used to spray one or more components. My prior art nozzle is directed to mixing sprayed components exteriorly of the nozzle. These present problems when the sprayed components include a material (such as insulating fiber) which needs to be wetted by a wetting adhesive prior to application to a substrate. These problems include non-homogeneous wetting of the material and the nonwetting and subsequent unwanted dispersal of material, fibers, or particles.

There has long been an unaddressed need for an efficient plural component spray nozzle. There has long been an unaddressed need for a plural component spray nozzle and methods for its use which provides a properly wetted material at the nozzle's exit port. There has long been an unaddressed need for a spray nozzle which provides adjustable material velocity and a variety of spray hoods. There has long been an unaddressed need for a spray nozzle which provides proper wetting and mixing of sprayed material within the nozzle itself.

SUMMARY OF THE INVENTION

The present invention is directed to spray nozzles and methods of their use. In one embodiment a spray nozzle according to this invention has a body member with a spray hood connected thereto or formed integrally thereof. A first material (including but not limited to insulation fibers) is conveyed through the body member, through the spray hood, and then out of an exit port in the spray hood. A liquid feed line connected to and through the spray hood extends into the interior of the spray hood. The liquid (including but not limited to an adhesive for insulating fiber material) is pumped through the liquid feed line and exits from an exit opening of a spray tip or nozzle into the interior of the spray hood. The first material and the liquid mix within the spray hood prior to expulsion therefrom; however, it is preferred that it be placed so that maximum saturation of material is achieved; small particles are wetted reducing or preventing dust dispersal; and material build up on the hood is reduced or eliminated so that lumps are not formed and blown out.

By selectively designing the spray hood the amount of liquid flowing through the spray hood, the velocity of the first material, the pressure of the medium pushing the first material, the density of material applied to a substrate can be varied and adjusted. Wetting of a first material within the spray nozzle can significantly reduce the generation of dust caused by non-wetted material. Various machines are used to pump materials through spray nozzles. By using an embodiment of the present invention and properly selecting spray hood size and configuration, different sizes and types of pumping machines and machines with different liquid pump rates and pressures may be used effectively. The body member can be fashioned so that a variety of spray hoods are removably attachable to the body member.

It is, therefore, an object of this invention to provide novel, efficient, nonobvious, and useful spray nozzles and methods for their use.

Another object of this invention is the provision of such nozzles which have apparatuses interiorly thereof for introducing a liquid, a wetting agent, or an adhesive into the nozzle's interior and for providing a spray hood interior chamber so that mixing with a material flowing through the nozzle occurs within the spray hood.

Yet another object of the present invention is the provision of such nozzles and methods which provide wetting of material within the spray hood and which reduce the generation of dust caused by non-wetted material flowing out of the nozzle.

A further object of this invention is the provision of a spray hood for such nozzles which provide an exit opening for liquid pumped into the interior of the nozzle.

An additional object of the present invention is the provision of individual adjustable spray hoods and a variety of spray hoods of different configurations so that the velocity of expelled material, the density of applied material, and the type of pumping equipment used can be varied and adjusted.

Another object of this invention is the provision of easily connectible and detachable interior spray hoods for such nozzles.

Yet another object of the present invention is the provision of a nozzle with a spray hood formed integrally thereof.

A particular object of the present invention is the provision of a spray nozzle for spraying insulating material and an adhesive for it so that some or all of the insulating material is wet with the adhesive when it exits from the nozzle.

Another object of this invention is to improve the comfort of a person using one of its embodiments by reducing the generation of dust.

Yet another object of embodiments of this invention is the reduction of overspray since the sprayed product is wetted inside the spray hood of the nozzle resulting in a concomitant reduction in necessary job preparation and clean-up.

A further object of this invention is to provide a spray nozzle with a hollow body member which serves as a conditioning chamber for compacted, tight, or held-together material such as fibrous insulating material, the hollow body member serving as an area in which such material can separate, loosen and re-mix; in one embodiment the hollow body member can have one or more enlarged areas to enhance these conditioning effects of loosening and re-mixing.

The present invention recognizes and addresses the previously-mentioned unaddressed long-felt needs and satisfies those needs in its various embodiments. To one of skill in this art who has the benefits of this invention's teachings and disclosures, other and further objects and advantages will be clear, as well as others inherent therein, from the following description of presently-preferred embodiments, given for the purpose of disclosure, when taken in conjunction with the accompanying drawings. Although these descriptions are detailed to insure adequacy and aid understanding, this is not intended to prejudice that purpose of a patent which is to claim an invention no matter how others may later disguise it by variations in form or additions or further improvements. The claims at the end of this specification are directed to this purpose.

DESCRIPTION OF THE DRAWINGS

FIG. 1 is a cross sectional view of a spray nozzle according to the present invention.

FIG. 2 is a partially-exploded cross-sectional view of the nozzle of FIG. 1.

DESCRIPTION OF PREFERRED EMBODIMENTS

Figure 3:
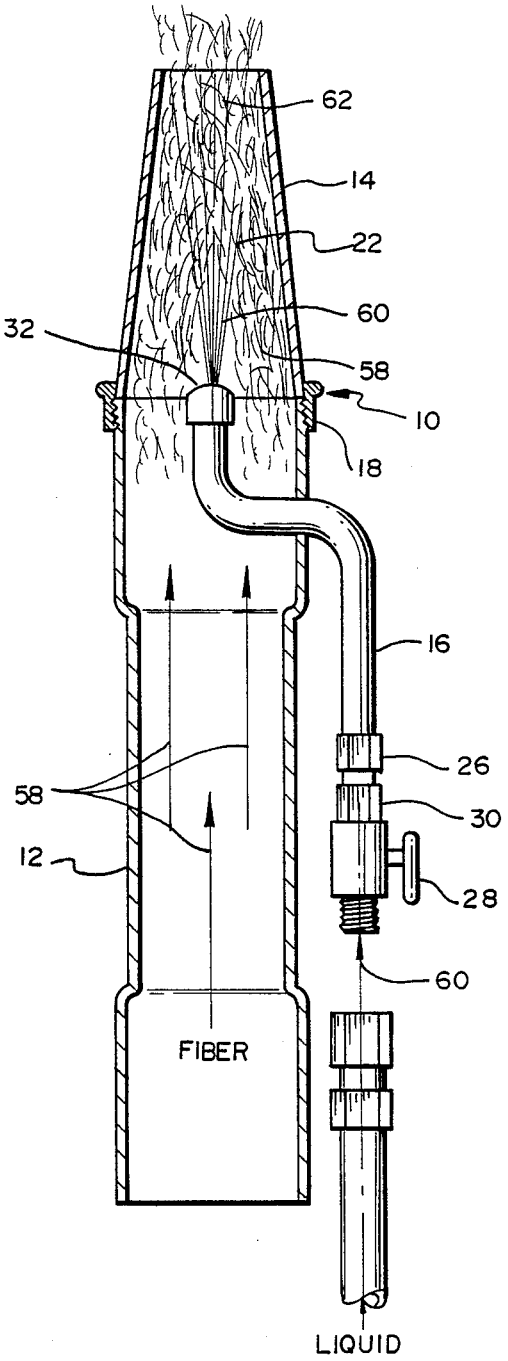
FIG. 3 is a cross sectional view of the nozzle of FIG. 1 showing materials conveyed therethrough.

Referring now to FIGS. 1–3, a spray nozzle 10 according to the present invention has a hollow body member 12 with a threaded output end 20 and a material input end 22. A spray hood 14 is connected to the body member 12 by a retaining ring 18. Material 58 to be sprayed is conveyed into and through the material input end 22, through the hollow body member 12, and into a conditioning chamber 50 in which the material, (e.g. but not limited to fibrous material) can "explode" or separate and loosen and then re-mix and flow into the spray hood 14. The chamber 50 is larger in cross-sectional area than the portion of the member 12 to which it is connected or of which it is integrally formed.

Held on the hollow body member 12 by a threaded retaining ring 18 which mates with the threaded output end 20 of conditioning chamber 50 of the hollow body member 12, the hollow interior spray hood 14 has an input end 52 and an exit opening 34. Of course the spray hood can be a permanent fixture on the outer spray member or formed integrally thereof; or it can itself be securable and secured to the outer spray member.

A threaded liquid atomizer or spray tip 32 is secured to a threaded end 24 of a liquid feed line 16 which extends from the spray hood 14, to the conditioning chamber 50 within the hollow outer member 12, and then exteriorly of the hollow outer member 12 through an opening 56. A liquid 60 for contacting the material pumped through the spray nozzle is fed through the liquid feed line 16 into the spray hood 14 where it contacts the material 58. A valve 28 connected at a connector 30 to the liquid feed line 16 provides valving action for the line.

As shown in FIG. 3 mixing of the material 58 and the liquid 60 occurs in mixing chamber 22 of the spray hood 14 before a mixture 62 exits through the exit opening 34. When the liquid is a wetting agent, wetting of the mixture 62 occurs prior to the exiting of the mixture.

When the liquid is an adhesive, adherence of particles or pieces or fibers of the material occurs within the spray hood before the mixture exits through the opening 34. By wetting material within the spray nozzle, dust which would be generated if the material were dry is significantly reduced. By providing a higher degree of wetness of the material and a homogeneous wetting, better adhesion to a substrate can be achieved.

In one preferred embodiment the material 58 is fibrous cellulose insulating material and the liquid 60 is commercially available SK-13-1C acrylic and sodium silicate mixture, water-based adhesive such as latexes or acrylics. Any suitable material or liquid can be sprayed with a spray nozzle according to the present invention, including, but not limited to:

Materials rock wool
Fiberglas (TM)
perlite
styrofoam beads

Liquids water-based adhesives
latex adhesives
acrylic adhesives

Of course it is within the scope of this invention to pump a mixture of two or more types of materials and to pump a mixture of two or more liquids or a liquid with particles of material in it. It is also within the scope of this invention to have more than one liquid feed line connected to and into the nozzle.

Figure 4:
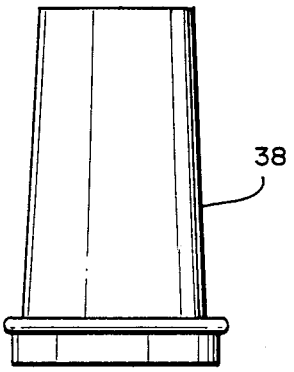
FIGS. 4–6 are cross sectional views of interior spray hoods according to the present invention.
Figure 5:
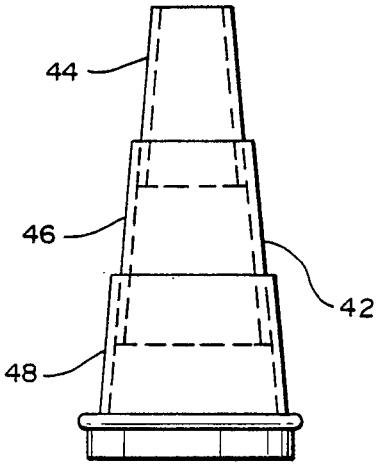
Figure 6:
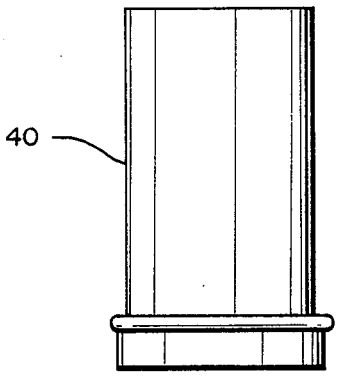

FIGS. 4 and 6 illustrate various embodiments of spray heads according to this invention. By varying the taper of the spray hood, i.e. making it more or less conical or simply straight, varying degrees of density of material application can be achieved; the more taper, the more dense the application. A spray head 42 as shown in FIG. 5 has three interconnected telescoping portions 44, 46, and 48.

Figure 7:
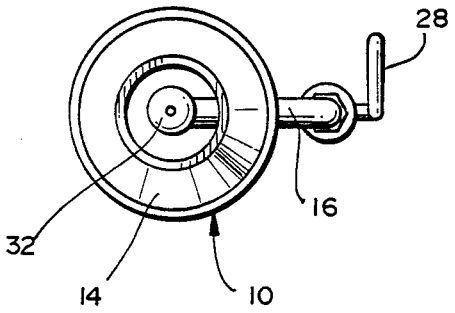
FIG. 7 is a front view of the spray hood of FIG. 1.

FIG. 7 illustrates a front view of the spray nozzle of FIG. 1.

Figure 8:
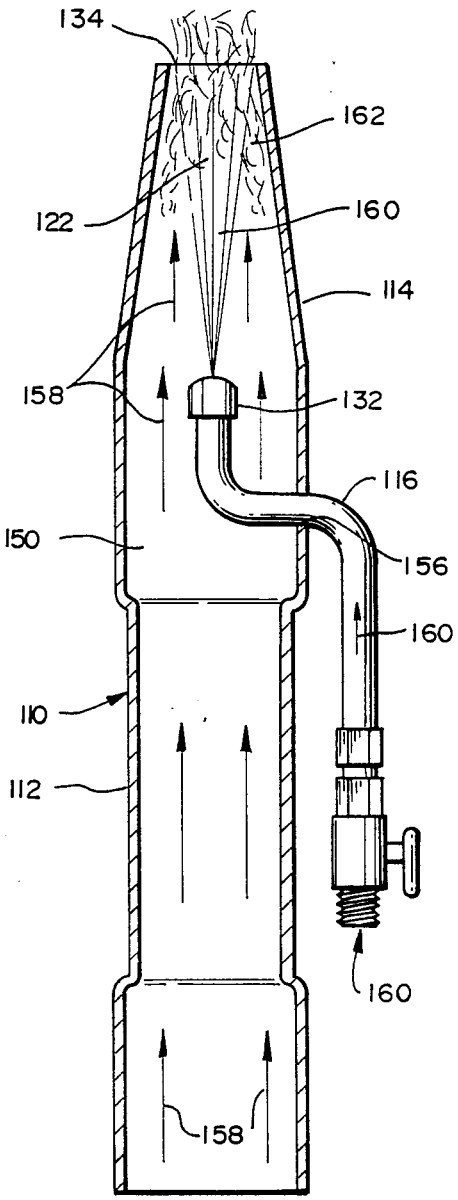
FIG. 8 is a cross-sectional view of a spray nozzle according t the present invention.

A spray nozzle 110 according to this invention is shown in FIG. 8 wherein the nozzle 110 has a body member 112 and formed integrally thereof a spray hood 114. A liquid line 116 projects through a hole 156 into a conditioning chamber 150 and a spray tip 132 is connected to the end of the liquid line 116 to spray a liquid 160 into a material 158 pumped through body member 112 to mix a mixture 162 in a mixing chamber 122 of the spray hood 114 which mixture is sprayed out from an exit port 134 of the spray hood 114. The conditioning chamber 150 functions as does the conditioning chamber 50 to permit compacted or tight material to loosen, separate and then re-mix.

Although it is preferred that a separate conditioning chamber such as 50 be provided, conditioning (separation, explosion, loosening, re-mixing) can occur in a hollow body member itself (such as 12) or in an enlarged end (such as 22) of a hollow body member. With a configuration as shown in FIG. 1, conditioning can occur in end 22, then in member 12, then in chamber 50.

Thus, it is seen that the apparatuses and methods of the present invention readily achieve the ends and advantages mentioned as well as other inherent therein. While certain preferred embodiments of the present invention have been described and illustrated for the purposes of disclosure, it will be clear to one of skill in this art who has the benefits of this invention's teachings that changes in the arrangement and construction of parts and steps may be made which changes are embodied within the spirit and scope of the present invention as claimed below. It is intended that each element or step recited in any of the following claims and each combination of elements is to be understood as referring to all equivalent elements or equivalent combinations for accomplishing substantially the same results in substantially the same or equivalent manner.

I claim:

1. A spray nozzle for spraying a mixture of fibrous insulating material and an adhesive for the fibrous insulating material, the nozzle comprising a generally cylindrical hollow body member with a first end and a second end, the fibrous insulating material conveyable under pressure into the first end and flowable freely through the hollow body member, a generally cylindrical material conditioning chamber connected to the second end of the hollow body member and having a larger cross-sectional area than the hollow body member so that a space is provided in which compacted fibers of the fibrous insulating material loosen, separate, and re-mix in a less compacted form prior to wetting of the fibrous insulating material, a generally conical hollow spray hood having an interior, the spray hood immediately adjacent to and connected to the material conditioning chamber, the re-mixed fibrous insulating material flowable from the material conditioning chamber directly into and through the spray hood, the spray hood having a mixing chamber therein and an exit opening through which the fibrous insulating material flows out of the spray nozzle, and an adhesive feed line connected to the spray nozzle and extending into the spray hood, the adhesive feed line having an end concentrically located in the hollow spray hood through which end liquid adhesive is fed into the fibrous insulating material to homogeneously wet it in the mixing chamber of the spray hood so that a mixture of the adhesive and the fibrous insulating material is sprayable out of the exit opening of the spray hood.

2. The spray nozzle of claim 1 wherein the hollow spray hood is detachably secured to the hollow body member.

3. The spray nozzle of claim 1 wherein the second end of the hollow body member is threaded for receiving and mating with a threaded retainer ring, the spray hood being detachably securable to the hollow body member, and the threaded retainer ring for holding the spray hood on the hollow body member.

4. The spray nozzle of claim 1 wherein the adhesive feed line extends through and exteriorly of the hollow body member.

5. The spray nozzle of claim 1 wherein a valve is provided on the adhesive feed line exteriorly of the hollow body member.

* * * * *